US005927410A

United States Patent [19]

Greer et al.

[11] Patent Number: 5,927,410

[45] Date of Patent: Jul. 27, 1999

[54] DRILL BIT NOZZLE AND METHOD OF ATTACHMENT

[75] Inventors: Richard L. Greer, Spring; Robert W. Arfele, Houston, both of Tex.

[73] Assignee: Dresser Industries, Inc., Dallas, Tex.

[21] Appl. No.: 08/866,677

[22] Filed: May 30, 1997

[51] Int. Cl.[6] ..... E21B 10/60

[52] U.S. Cl. ..... 175/393; 175/424

[58] Field of Search ..... 175/339, 340, 175/424, 67, 107, 393; 411/178, 285; 239/589, 600; 81/177.5

[56] References Cited

U.S. PATENT DOCUMENTS

| | | | |
|---|---|---|---|
| 4,006,660 | 2/1977 | Yamamoto et al. | 411/405 |
| 4,533,005 | 8/1985 | Morris | 175/393 |
| 4,542,798 | 9/1985 | Madigan | 175/340 |
| 4,603,750 | 8/1986 | Sorenson | 175/340 |
| 4,658,918 | 4/1987 | Matson | 175/423 |
| 4,776,412 | 10/1988 | Thompson | 175/393 |
| 4,794,995 | 1/1989 | Matson et al. | 175/393 |
| 4,878,548 | 11/1989 | Ostertag et al. | 175/340 |
| 5,337,958 | 8/1994 | Hennessy et al. | 239/600 X |

FOREIGN PATENT DOCUMENTS

| | | | |
|---|---|---|---|
| 1229443 | 4/1971 | United Kingdom | 411/402 |

*Primary Examiner*—David J. Bagnell
*Assistant Examiner*—Abdel G. Elkassed
*Attorney, Agent, or Firm*—Browning Bushman

[57] ABSTRACT

A fluid nozzle for threaded insertion into a drill bit. The nozzle is equipped with a drive head that receives a socket-type torquing tool. The torque forces exerted by the tool compress the drive head, permitting larger torque forces to be exerted on the nozzle without breakage of the drive head that occurs where a tension force is produced in the drive area by the torquing tool. Use of a compressive drive structure permits the use of less material, which in turn permits a larger flow passage to be formed through the nozzle for a given nozzle size. The facets of the drive area may be inclined relative to the nozzle axis to limit the torque force applied by a drive tool. When the torque force exceeds a limit determined by the configuration and inclination of the facets, the tool is forced axially off of the drive area. This feature controls the amount of torque applied to the nozzle and prevents nozzle damage. Inclining the lands of the drive area also assists in preventing breakage of a nozzle formed from tungsten carbide as the nozzle shrinks away from a die form during the heating step in the fabrication process of the nozzle.

23 Claims, 2 Drawing Sheets

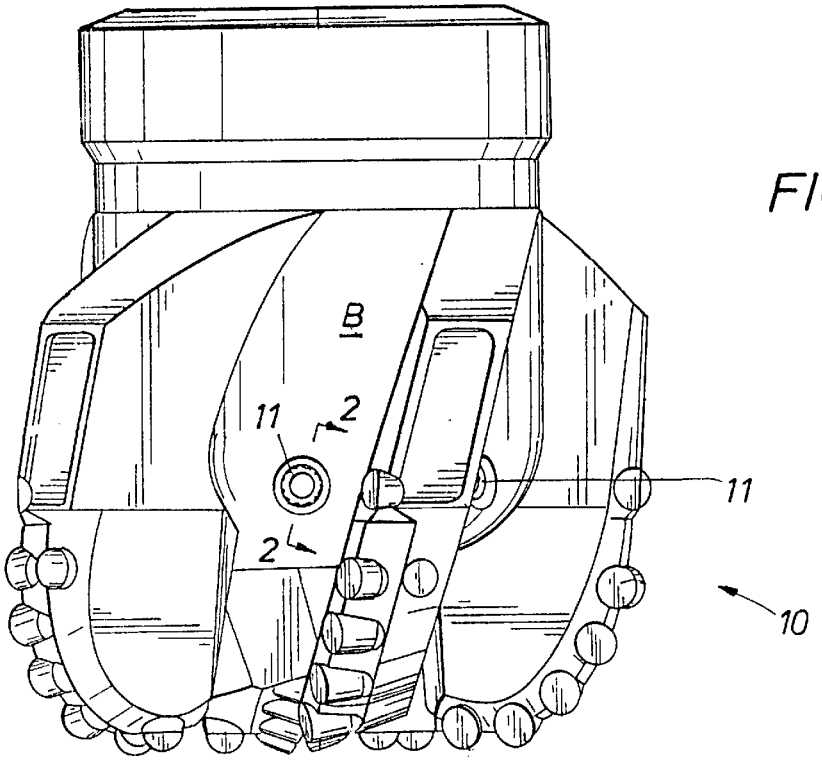
FIG. 1
FIG. 3
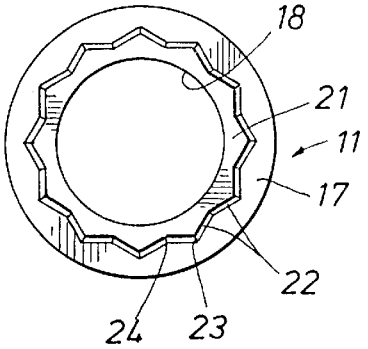
FIG. 2
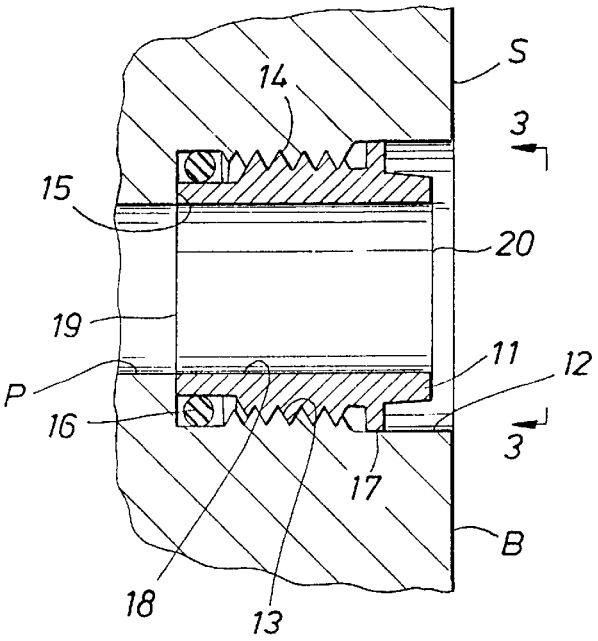
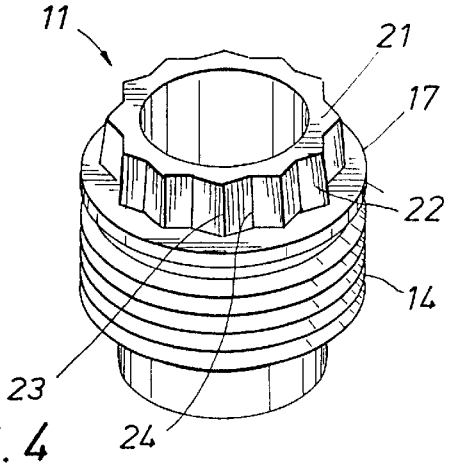
FIG. 4

FIG. 5
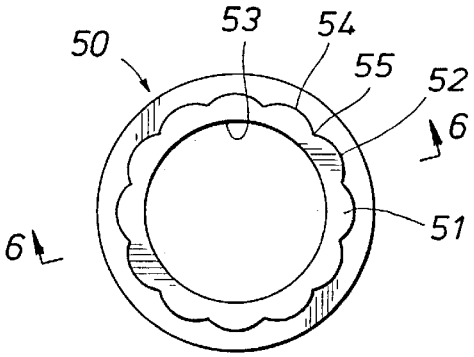
FIG. 6
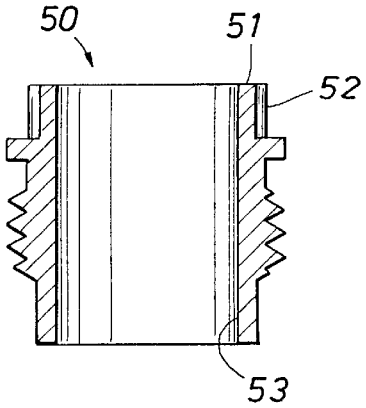
FIG. 7
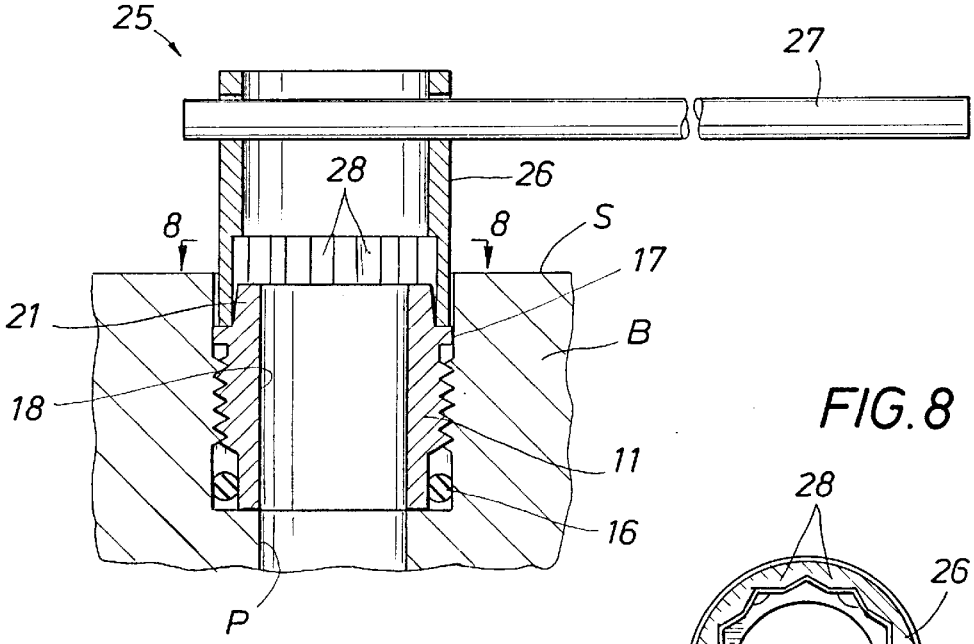
FIG. 8
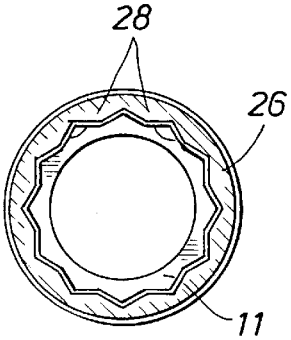
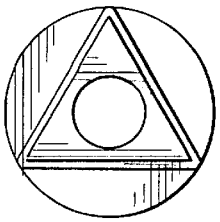
FIG. 9
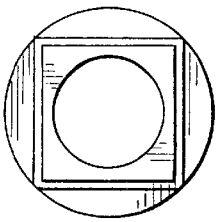
FIG. 10
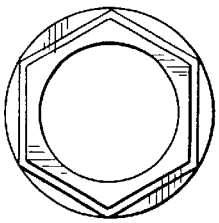
FIG. 11

DRILL BIT NOZZLE AND METHOD OF ATTACHMENT

BACKGROUND OF THE INVENTION

1. Field of the Invention

The present invention relates generally to fluid nozzles for use on a drill bit. More specifically, the present invention relates to an improved nozzle and method of using compression torque forces to engage and disengage the nozzle and bit.

2. Description of the Prior Art

Wells used to extract hydrocarbons from the earth are formed using drill bits that are rotated by a length of drill pipe from a drilling rig located at the well surface. Drilling fluid is pumped through the drill string to the bit, where it exits the bit into the wellbore. The fluid serves to cool and lubricate the bit and to return the formation bit cuttings back to the well surface.

The drill bit is equipped with nozzles that control the exiting fluid velocity, direction, and pattern of flow. The nozzle is typically threadedly engaged within a receptacle in the bit body and has a central flow passage that communicates with the drilling fluid supplied through the drill string. The nozzle is fabricated of a material, such as tungsten carbide, that can withstand the erosive forces resulting from the flow of the high pressure, abrasive drilling fluids. The nozzles are removable to permit replacement, as well as to allow a variety of different nozzles having different flow characteristics to be employed with a particular bit.

Material such as tungsten carbide, while well suited for withstanding the effects of erosion, is extremely brittle and subject to breakage. Torque forces applied to the nozzle while seating or withdrawing the nozzle from a bit must be controlled to prevent nozzle breakage. The brittleness of the material also makes the nozzle subject to breakage as a result of fractures that originate at stress concentration points, such as occur at the intersection of planar surfaces in the nozzle drive area. Prior art nozzle designs have addressed the problems of breakage by employing relatively large amounts of tungsten carbide material in the nozzle drive area.

Damage to the drive area of the nozzle is to be avoided because of the danger of creating stress concentration points that reduce the drive area strength. Such damage can occur, for example, during application of the nozzle to the bit, or from fluid erosion of the surfaces of the drive area, or from die adhesions occurring during the fabrication of the nozzle. In fabricating the nozzle, a powder material that includes tungsten carbide is typically compacted into a die having the desired nozzle shape and then heated to a temperature that converts the powdered material into a hard, solid body. During this heating process, the compacted material shrinks in volume and draws away from the surrounding die. Many conventional nozzle drive area surfaces are essentially parallel to the axis of the nozzle and tend to adhere to the die surface as the nozzle form moves axially during the shrinking process. These adhesions cause material to break away from the drive area of the nozzle, resulting in a defective drive area. It is desirable in the design of such bodies to minimize the number of such parallel surfaces to reduce the frequency of defective nozzle formations.

Conventional nozzles are rotated into the threaded bit receptacle with the aid of a drive tool that engages a drive area structure formed on the fluid exit end of the nozzle. This drive area structure typically may take the form of a slot designed to be engaged by a blade-type tool or a multisided opening designed to be engaged by an allen wrench-type tool. Other tool-engaging drive area designs are also used, each generally requiring that a tool be engaged with a drive surface that prevents relative rotation between the tool and the nozzle so that torque is imparted to the nozzle as the tool is rotated.

The drive area structures in such prior art nozzles are subjected to tensile stresses as the tool is rotated by the drive tool. Forces that exceed the tensile limits of the drive area structure can cause the nozzle to break. If the amount of material employed in the drive area of the nozzle is increased to accommodate greater torque forces, the flow passage dimensions extending through the drive area must be decreased. It is desirable to employ as little material as possible in a nozzle to keep material costs as low as possible and to keep the nozzle size as small as possible.

SUMMARY OF THE INVENTION

The nozzle of the present invention is provided with a drive area that concentrates the torque application forces of the drive tool into compressive and radially inwardly directed forces rather than tensile forces. As a result, the volume of material required to provide a structurally sound drive area is substantially reduced as compared with that required for a drive area subjected to tension forces by the drive tool. Reduction in the drive area material also permits the use of a larger flow passage through the nozzle body, which reduces the cost of the nozzle and allows it to be used in smaller bit areas.

The drive area of one embodiment of the nozzle is provided with axially inclined lands that may be engaged by a surrounding torque application drive tool. The axial inclination of the lands cooperates with the drive tool structure to limit the amount of torque that may be applied to the nozzle before the tool is forced axially off of the drive area. By this means, the proper seating torque may automatically be applied to the nozzle, and the total torque applied to the nozzle may also be limited to prevent damage to the drive area. A related benefit from the use of inclined drive area surfaces is that the nozzle body breaks cleanly away from the die during the heating process employed in the fabrication of the nozzle. The frequency of firing damage is thus substantially reduced as compared with the damage occurring where the drive surfaces are not axially inclined relative to the nozzle axis.

The external drive area of a preferred form of the nozzle of the present invention is also configured to reduce the number of sharp intersections that concentrate stresses in the drive area to thereby minimize the likelihood of damaging the drive area. The design also permits the use of minimal amounts of material in the nozzle drive area to adequately withstand the anticipated torquing forces required in seating or removing the nozzle. One configuration of the drive area of the nozzle of the present invention employs multiple, curving intersecting surfaces that form a substantially circular external drive area. The cooperating drive tool fits over the drive area, and internal interfering surfaces in the tool engage the external drive area surfaces of the nozzle to transfer the torque forces between the tool and the nozzle.

The preferred embodiments of the drive area of the nozzle of the present invention are provided with lateral dimensions that are less than the lateral dimensions of the bit recess within which they are to be received. The difference in dimensions permits the drive tool to be received between the nozzle drive area and the surrounding receptacle so that the nozzle may be rotated into place with the drive area positioned below the surface of the bit.

The nozzle drive area design of the present invention enables the drive area surfaces of the nozzle to be positioned out of the flow path of the drilling fluid exiting the nozzle so that the drive area surfaces are protected from fluid erosion.

From the foregoing, it will be appreciated that a primary object of the present invention is to provide a drilling fluid nozzle for use in a drill bit that may be threadedly engaged and disengaged from the drill bit using torque forces that compress the drive area of the nozzle.

Another important object of the present invention is to provide a nozzle for use in a drill bit that can be provided with a relatively large central flow passage in a relatively small laterally extending nozzle body.

Yet another object of the present invention is to provide a nozzle having a drive area with a multifaceted external configuration that may be engaged by a surrounding drive tool whereby the torque applied to the drive area by the tool is distributed uniformly throughout the drive area and is compressive and radially inwardly directed toward the central axis of the nozzle to minimize the size and the amount of material required in the drive area of the nozzle.

Another important feature of the present invention is the provision of a nozzle having a drive area with axially inclined surfaces adapted to engage similar surfaces in a surrounding drive tool whereby the drive tool is forced off of the drive area when the torque applied by the drive tool exceeds a predetermined limit established by the angle of inclination of the drive area surfaces as well as the configuration of such surfaces.

Yet another object of the present invention is to provide a nozzle having a drive area in which the drive area surfaces are inclined axially relative to the nozzle axis so that the drive area will separate freely from the die employed in fabricating the nozzle.

The foregoing features, advantages, and objects of the invention, as well as other features apparent to those skilled in the art, will be more fully described and understood by reference to the following drawings, specification, and claims.

BRIEF DESCRIPTION OF THE DRAWINGS

FIG. 1 is a vertical elevation illustrating a drill bit equipped with fluid nozzles of the present invention;

FIG. 2 is a partial cross-sectional view taken along the line 2—2 of FIG. 1 illustrating the nozzle of the present invention threadedly received within a receptacle in a drill bit body;

FIG. 3 is a plan view taken along line 3—3 of FIG. 2 illustrating a preferred configuration of the external torque application drive area on a nozzle of the present invention for engagement with a tool used to rotate the nozzle;

FIG. 4 is a perspective view of the nozzle illustrated in FIG. 3;

FIG. 5 is a plan view of a modified form of the nozzle of the present invention illustrating a variation in the external drive area of the nozzle;

FIG. 6 is a cross-sectional view taken along the line 6—6 of FIG. 5;

FIG. 7 is a vertical section of a broken away portion of a drill bit body illustrating a drive tool engaging a nozzle of the present invention for threadedly engaging or disengaging the nozzle and the bit body;

FIG. 8 is a partial horizontal cross-section taken along the line 8—8 of FIG. 7;

FIG. 9 is an illustration of a modified configuration for an external drive area of the present invention;

FIG. 10 is another modification of an external drive area for the present invention; and FIG. 11 is another modification of the external drive area of the present invention.

DESCRIPTION OF THE EMBODIMENTS

The present invention, indicated generally at 10 in FIG. 1, comprises a drill bit B equipped with fluid nozzles 11, constructed and employed in accordance with the teachings of the present invention. The nozzles 11 are threadably received in the body of the drill bit B and function to convey drilling fluids from the bit into the wellbore being drilled. The pressurized drilling fluids exiting the nozzles function conventionally to cool and cleanse the drill bit as well as to assist in breaking away the formation being penetrated by the drill bit. Fluid exiting the nozzles 11 and circulating up through the annular between the drill string and the wellbore is also employed to transport the bit cuttings to the well surface.

It will be appreciated that the placement and orientation of the nozzles 11 illustrated in FIG. 1 are merely illustrative of the application of such nozzles to a drill bit and that the specific placement and orientation of the nozzles on the bit as well as the bit design may be selected to best meet the requirements of a particular drilling application.

As may be best described with joint reference to FIGS. 1 and 2, the nozzle 11 is a cylindrical body received within a cylindrical bore 12 that extends through the body of the bit B and communicates through a passage P with a central drilling fluid supply passage (not illustrated) that delivers the drilling fluids to the nozzle 11. The bore 12 is equipped with internal threads 13 that engage and mate with external threads 14 formed on the axially extending, cylindrical outer surface of the nozzle 11. An annular shoulder 15 formed between the bore 12 and the passage P provides a lower stop against which the nozzle 11 rests when it is fully engaged in the bit body. An annular, elastomeric O-ring seal 16 is compressed between the bore 12, the shoulder 15, and the lower annular end of the nozzle 11. An annular protective lip 17 is provided at the top of the threads 14.

The nozzle 11 is provided with an axially extending central flow passage 18 that provides fluid communication through the nozzle between a fluid passage inlet end 19 and a fluid passage outlet end 20. When the nozzle is seated within the bit, the nozzle outlet end 20 is disposed below the surrounding external surfaces of the drill bit B. This placement of the nozzle protects the nozzle structure from contact with the formation.

With reference to FIG. 3, the nozzle 11 is equipped with a multifaceted drive area 21 that is adapted to be engaged by a surrounding drive tool for rotating the nozzle threads 14 into or out of threaded engagement with the bore threads 13. The annular lip 17 functions as a stop to limit the axial position of the drive tool. The drive area is formed around the central flow passage 18 and is provided with radially external surface areas that may be engaged by a tool having appropriately matching opposing surfaces. The engagement of the drive area surfaces of the nozzle and the opposed surfaces of the drive tool are selected such that when the tool engages the drive area, the mating surfaces interfere with and prevent relative rotation between the tool and the nozzle 11 as torque is being applied by the tool to the nozzle.

A preferred form of the interfering tool and nozzle drive structure, illustrated in FIG. 3, assumes the form of a series of axially inclined lands 22 with tapering planar surface areas that intersect each other to form a series of alternating peaks 23 and valleys 24. The peaks 23 and valleys 24 form line intersections that incline toward the central axis of the nozzle 11 when viewed in a plane that includes both the axis and a peak, or, the axis and a valley.

The drive area surfaces 22 are isolated from the flow passage 18 to protect them from erosion. The lands 22 of a preferred form of the invention incline at 7° relative to the axis of the nozzle. The inclination may vary from 7° to as much as 20° as required to assist in controlling the torque force applied to the nozzle.

In the modification illustrated in FIGS. 1–4 and 7, the drive area forms an external surface of twenty-four lands with twelve peaks and twelve valleys that cooperate to form a substantially circular drive area in the area of the fluid exit. In general, the greater the number of lands in the drive area, the more uniform the distribution of the compressive drive forces in the drive area body and the greater the ability of the drive area to resist fracture.

It will be appreciated by reference to the illustrations that the axial extent of the drive area of the nozzle is relatively small as compared to the entire nozzle length. A nozzle using the compressive drive area of the present invention may be provided with a drive area that, as compared with prior designs, occupies a reduced portion of the total nozzle height or volume while still providing adequate strength for withstanding the torquing forces used in seating and extracting the nozzle.

FIG. 7 illustrates an example of a drive tool, indicated generally at 25, that may be employed to threadedly engage or disengage the nozzle 11 and the bore 12. The tool 25 includes a conventional tubular socket drive head 26 that is equipped with a drive handle 27. The tubular socket head 26 fits over the drive area 21 of the nozzle 11 so that the base of lands 28 formed on the internal surface of the socket head engage and mate with the base of the lands 22 formed on the nozzle 11. The external lateral dimensions of the drive area 21 are selected to be sufficiently smaller than those of bore 12 so that the tubular body of the tool socket 26 may be positioned over the drive area and enter the bore 12 as the drive area nozzle is advanced below the bit surface S. Because of the rotational interference between the socket head lands 28 and the nozzle lands 22, rotary torque imparted through the socket head 26 is transferred to the nozzle 11.

In a preferred form of the invention, the pattern of the interfering structure at the base of the internal surface of the drive tool 25 is substantially a matching image of the external drive surface on the nozzle 11. It will be appreciated, however, that the tool and nozzle interface need not match but need only have forms that produce interference that prohibits the two pieces, when engaged, from rotating relative to each other so that torque imparted through the tool is applied to the nozzle.

The form of the interfering tool and nozzle structure illustrated in FIG. 7 provides the added benefit of limiting the torque that may be applied to the drive area 21 to prevent over-torquing the nozzle. Depending upon the number and inclination of the nozzle lands 22 and the geometry of their engagement or interference with the tool 26, the tool 26 will be urged axially away from the base of the nozzle lands when the interfering torque between the nozzle and the tool exceeds a predetermined value. This feature thus limits the torque that may be applied to the nozzle. The value of maximum torque that can be applied to the nozzle may also be selected to maintain the torquing forces within the strength limitations of the nozzle drive area to prevent damage to the nozzle as well as to ensure that the proper seating torque has been applied to the nozzle.

FIG. 5 illustrates a modified form of a nozzle, indicated generally at 50. As may be noted by joint reference to FIGS. 5 and 6, the nozzle 50 is equipped with a drive area 51 that includes a series of non-inclined, arcuate surfaces 52 that connect in curving intersections to form an annular ring about the central passage 53. The drive area 51 includes a series of alternating curving peaks 54 and curving valleys 55 that extend around the external surface of the drive area to form the interfering structure for the torque application tool. The curved intersections assist in distributing the torque forces through the drive area and in reducing sharp stress risers at surface intersections. As seen best in FIG. 6, the arcuate surfaces 52 are substantially parallel with the central axis of the nozzle 50 rather than inclining toward the axis as with the embodiment of FIG. 3. A drive tool (not illustrated) suitable for use with the nozzle 50 may include any surrounding conforming or interfering internal drive surface that will prevent rotation of the tool relative to the drive area 52 and will also be accommodated within a bit receptacle that receives the nozzle.

It will be appreciated that the tool engaging the drive area 51 may include inclined surfaces that interfere with the non-inclined drive surfaces 52 to limit the torque applied to the nozzle 50. It will also be appreciated that a drive tool with non-inclined engagement surfaces may be employed with a non-inclined drive surface on any of the nozzle forms of the present invention to produce contact interference between the components that does not urge the tool away from the nozzle. Such a tool and nozzle combination would obviously not be torque limiting.

FIGS. 9, 10, and 11 illustrate other examples of configurations having inclined external drive areas that are capable of being engaged by a surrounding drive tool with a suitable mating drive surface to impart limited torque to the engaged nozzle.

In the forms of the invention using a smaller number of lands, such as illustrated in FIGS. 9–11, the lands are inclined to limit the torque applied by a surrounding drive tool. As the number of lands increases above six, the outer drive area begins to assume a substantially circular configuration that permits increasingly larger central flow passages to be formed through the nozzle. The configuration is optimized as the external drive area more closely approximates a true circular form. The upper limit on the number of lands is reached at a form that cannot provide sufficient interference with a drive tool to transmit the drive torque. Multifaceted configurations with fewer than this upper limit of lands are referred to herein as being substantially circular.

In each of the illustrated embodiments, the configurations of the nozzles of the present invention are such that the application of torque force to the nozzle by a drive tool directs the torque forces centrally towards the axis of the nozzle to produce compressive forces within the drive area. The result is that the drive areas of the nozzles may be made with substantially less material than is required where the torque is imparted by a tool that imposes tension forces in the drive area. The reduction in material is associated with a reduction in the cost of manufacturing the nozzle and with an increase in the size of the nozzle flow opening.

An important advantage of the nozzle design of the present invention is realized in those configurations having a relatively large number of lands or peaks and valleys, as, for example, the forms illustrated in FIGS. 4 and 5, which are provided with relatively large central openings 18 and 53, respectively. As the flow opening diameter is increased in a conventional nozzle having a tension-producing drive area, more material is needed in the drive area to withstand the tension-producing torque forces used in seating and removing the nozzle from the bit body. This extra material requires a larger diameter nozzle body to permit the larger diameter flow openings. By contrast, the form of the nozzle of the present invention, having a relatively larger number of lands or arcuate surfaces or other interfering surface designs in a compression-type drive, results in a nozzle that can have a relatively large flow passage without requiring large amounts of strengthening material in the drive area. The benefit is a smaller, stronger, and less costly nozzle as compared with a conventional nozzle having the same size flow passage.

The foregoing description and examples illustrate selected embodiments of the present invention. In light thereof, variations and modifications will be suggested to one skilled in the art, all of which are in the spirit and purview of this invention.

What is claimed is:

1. A nozzle for use in a drill bit, comprising:

an axially extending nozzle body having a substantially cylindrical outer surface and first and second axial ends;

a flow passage extending axially through said nozzle body between said first and second axial ends, said flow passage comprising an internal surface of said nozzle body;

a fluid inlet included in said flow passage at said first axial end of said nozzle body;

a fluid outlet included in said flow passage at said second axial end of said nozzle body;

a substantially cylindrical threaded area formed on said outer surface of said nozzle body intermediate said first and second axial ends for engaging said nozzle in a threaded receptacle extending into a drill bit body;

a radially external drive area associated with said second axial end of said nozzle body for receiving a torque-imparting tool for threading said nozzle into or out of said threaded receptacle wherein the lateral dimensions of said drive area are smaller than the lateral dimensions of said receptacle area whereby said tool may be positioned between said drive area and said bit receptacle to impart torque to said nozzle when said drive area is substantially fully received within said receptacle; and axially inclined, multifaceted external surfaces formed on said drive area for cooperation with surrounding facets on a torque-imparting tool to prevent relative rotation between said tool and said drive area whereby torque applied by said tool is transferred to said nozzle body.

2. A nozzle as defined in claim 1 wherein said facets on said drive area are inclined axially toward said flow passage and said flow passage extends centrally through said nozzle.

3. A nozzle as defined in claim 1 wherein said drive area is substantially coaxial with said flow passage.

4. A nozzle as defined in claim 1 wherein said multifaceted external surfaces comprise at least three substantially planar surfaces circumferentially spaced about said drive area.

5. A nozzle as defined in claim 1, further comprising in combination:

a tool adapted to engage said drive area for imparting torque to said nozzle body; and facets on said drive tool adapted to engage said drive area for limiting the torque applied by said tool to said drive area.

6. A nozzle for use in a drill bit, comprising:

an axially extending nozzle body having a substantially cylindrical outer surface and first and second axial ends;

a flow passage extending axially through said nozzle body between said first and second axial ends, said flow passage comprising an internal surface of said nozzle body;

a fluid inlet included in said flow passage at said first axial end of said nozzle body;

a fluid outlet included in said flow passage at said second axial end of said nozzle body;

a substantially cylindrical threaded area formed on said outer surface of said nozzle body intermediate said first and second axial ends for engaging said nozzle in a threaded receptacle extending into a drill bit body;

a radially external drive area associated with said second axial end of said nozzle body for receiving a torque-imparting tool for threading said nozzle into or out of said threaded receptacle wherein the lateral dimensions of said drive area are smaller than the lateral dimensions of said receptacle area whereby said tool may be positioned between said drive area and said bit receptacle to impart torque to said nozzle when said drive area is substantially fully received within said receptacle; and multifaceted external surfaces formed on said drive area for cooperation with surrounding facets on a torque-imparting tool to prevent relative rotation between said tool and said drive area whereby torque applied by said tool is transferred to said nozzle body wherein said multifaceted external surfaces comprise at least seven surfaces circumferentially spaced about said drive area.

7. A nozzle as defined in claim 6 wherein said multifaceted external surfaces comprise approximately twenty-four substantially planar surfaces disposed circumferentially about said drive area.

8. A nozzle as defined in claim 6 wherein said facets comprise multiple arcuate surfaces spaced circumferentially about said drive area.

9. A nozzle as defined in claim 6 wherein said facets comprise a plurality of substantially non-planar surfaces spaced circumferentially about said drive area.

10. A nozzle as defined in claim 6 wherein said facets comprise a plurality of axially inclined, circumferentially disposed surfaces.

11. A nozzle as defined in claim 6 wherein said drive area surfaces are adapted to be externally engaged by a drive tool whereby torque application by said tool produce forces in said drive area directed primarily toward said flow passage.

12. A nozzle as defined in claim 6 wherein said tool drive area of said nozzle is adapted to be received within said threaded receptacle while being engaged by said tool.

13. A nozzle as defined in claim 6 wherein said drive area is substantially coaxial with said flow passage.

14. A nozzle as defined in claim 13 wherein said drive area surfaces are adapted to be externally engaged by said tool whereby torque application by said tool produce forces in said drive area directed primarily forward said flow passage.

15. A nozzle as defined in claim 14 wherein said facets comprise a plurality of axially inclined surfaces.

16. A nozzle for a drill bit, comprising:

an elongate nozzle body having a substantially cylindrical external surface section, a fluid exit, and a fluid entry;

a flow passage extending between said exit and entry for carrying fluid through said nozzle;

a threaded area on said cylindrical surface for engaging said nozzle in a threaded receptacle;

a substantially circular, radially external drive area in the area of said fluid exit for receiving a tool for applying torque to said body to thread and unthread said body in a threaded receptacle, said drive area having a maximum lateral dimension less than the maximum lateral dimension of said receptacle area; and a multifaceted tool surface on said drive area whereby torque applied by a tool to said external tool surface produces drive area forces in the direction of said flow passage.

17. A nozzle as defined in claim 16 wherein said multifaceted tool surface is isolated from said flow passage.

18. A nozzle as defined in claim 16 wherein said tool surface comprises a plurality of axially inclined, circumferentially spaced planar surfaces.

19. A nozzle as defined in claim 16 herein said nozzle body is fabricated of tungsten carbide.

20. A method of inserting or removing an axially extending threaded nozzle from a drill bit receptacle comprising the steps of applying a rotatable torque tool to a radially external drive area of said nozzle, applying rotary torque with said tool to said drive area to produce resultant forces in said drive area that are substantially compressive and directed radially inwardly toward said nozzle axis, said tool being receivable between said drive area and said receptacle; and applying said torque to said drive area when said drive area is fully received within said receptacle.

21. A method as defined in claim 20 wherein said resultant forces are produced at distributed points about the periphery of said drive area.

22. A method as defined in claim 20 wherein said nozzle includes a central passage and a drive area distributed about said central passage.

23. A method as defined in claim 20 wherein said nozzle includes a drive area having approximately twenty-four facets whereby said resultant forces are exerted at twelve points about said passage.

* * * * *

UNITED STATES PATENT AND TRADEMARK OFFICE

CERTIFICATE OF CORRECTION

PATENT NO. : 5,927,410

DATED : July 27, 1999

INVENTOR(S) : Richard L. Greer and Robert W. Arfele

It is certified that error appears in the above-identified patent and that said Letters Patent is hereby corrected as shown below:

In column 8, line 52, delete "produce" and insert therefor --produces--.

In column 8, line 61, delete "produce" and insert therefor --produces--.

In column 8, line 62, delete "forward" and insert therefor --toward--.

In column 9, line 20, delete "herein" and insert therefor --wherein--.

Signed and Sealed this

Fifteenth Day of February, 2000

*Attest:*

Q. TODD DICKINSON

*Attesting Officer*

*Commissioner of Patents and Trademarks*